US007344231B2

(12) United States Patent
Talon et al.

(10) Patent No.: US 7,344,231 B2
(45) Date of Patent: Mar. 18, 2008

(54) INKJET DIGITAL PRINTING DEVICE AND INK RESERVOIR

(75) Inventors: Ludovic Talon, Grenoble (FR); Eric Auboussier, Saint Jean de Braye (FR); Yannick Suzanne, Châteauneuf sur Loire (FR); Sarah Suzanne, Châteauneuf sur Loire (FR)

(73) Assignee: Datacard Corporation, Minnetonka, MN (US)

( * ) Notice: Subject to any disclaimer, the term of this patent is extended or adjusted under 35 U.S.C. 154(b) by 0 days.

(21) Appl. No.: 10/995,199

(22) Filed: Nov. 24, 2004

(65) Prior Publication Data

US 2005/0128231 A1 Jun. 16, 2005

Related U.S. Application Data

(63) Continuation of application No. 10/483,522, filed on Jan. 13, 2004, now abandoned.

(51) Int. Cl.
*B41J 2/175* (2006.01)
*B41J 2/195* (2006.01)

(52) U.S. Cl. ..... 347/85; 347/7

(58) Field of Classification Search ..... 347/67, 347/17, 5, 1, 20, 9, 7, 89, 73, 74, 76, 77, 347/93, 92, 6, 22, 23, 33, 84–87
See application file for complete search history.

(56) References Cited

U.S. PATENT DOCUMENTS 4,183,030 A 1/1980 Kaieda et al.
4,246,489 A * 1/1981 Yoshida et al. ..... 250/577
4,270,589 A 6/1981 Heinzl
5,489,925 A 2/1996 Moynihan et al.
6,364,447 B1 * 4/2002 Boleda et al. ..... 347/19
6,402,291 B1 * 6/2002 Millman et al. ..... 347/33

(Continued)

FOREIGN PATENT DOCUMENTS

EP 0 822 083 A 2/1998

(Continued)

OTHER PUBLICATIONS

Patent Abstracts of Japan, vol. 006, No. 089 (M-132), May 27, 1982 and JP 57 027757 A (Ricoh Co. Ltd) Feb. 15, 1982, Abstract.

(Continued)

*Primary Examiner*—Stephen Meier
*Assistant Examiner*—Geoffrey S. Mruk
(74) *Attorney, Agent, or Firm*—Miles & Stockbridge P.C.; Edward J. Kondracki

(57) ABSTRACT

The present invention relates to a digital device for printing on "open" or "closed" surface substrates by demand bubble-jet comprising at least one built-in ink reservoir (13) with a system of anti-splash partitions, at least one printhead and one buffer reservoir, the whole located in a print module (1) which moves in relation to the substrate (5). The device comprises a means for creating, during operation of the module, on the one hand, a vacuum in the built-in reservoir, with a method of active regulation of this vacuum by adjustment of the ink level detected by a sensor attached to the built-in reservoir and, on the other hand, the air pressure in the built-in reservoir required for printhead cleaning phases.

18 Claims, 5 Drawing Sheets

U.S. PATENT DOCUMENTS

| | | | | |
|---|---|---|---|---|
| 6,543,877 | B1 * | 4/2003 | Boutet et al. | 347/30 |
| 6,631,983 | B2 * | 10/2003 | Romano et al. | 347/89 |
| 6,705,711 | B1 * | 3/2004 | Richards | 347/85 |

FOREIGN PATENT DOCUMENTS

| | | |
|---|---|---|
| EP | 0 987 113 A2 | 9/1999 |
| EP | 1 053 877 A | 11/2000 |

OTHER PUBLICATIONS

Patent Abstracts of Japan, vol. 015, No. 182 (M-1111), May 10, 1991 and JP 03 043387 A (Takiron Co. Ltd.) Feb. 25, 1991 Abstract.
Patent Abstracts of Japan, vol. 2000, No. 19 Jun. 5, 2000 and JP 2001 042728 A (Seiko Epson Corp.) Feb. 16, 2001, Abstract.

* cited by examiner

INKJET DIGITAL PRINTING DEVICE AND INK RESERVOIR

This application is a continuation of application Ser. No. 10/483,522 filed Jan. 13, 2004 now abandoned.

BACKGROUND OF THE INVENTION

1. Field of the Invention

The present invention relates to a digital printing device operating by spraying ink onto a substrate, which may have either an "open" in other words absorbent surface such as for example paper or cardboard, or a "closed" in other words non-absorbent surface such as for example some plastic materials or glass. The principle of this so-called ink jet technology consists in spraying fine ink drops onto the substrate in a matrix based pattern, so as to print characters or graphics from digital data.

2. Description of Related Art

This printing principle has been in use since about the 1970s in respect of black and white and since the 1980s in respect of color printing. Applications exist in particular in the field of high-speed printing, low-cost color printers for personal computers, or industrial printing on a variety of substrates. The present description applies to printing on any substrate, <<open>> or <<closed>>, for example by a machine for customizing plastic cards or other portable objects, but it is obvious that such an invention may also apply to a number of other cases.

In the case of industrial machine printing, printing is carried out by a printhead including one or more electronically controlled print nozzles supplied by a reservoir containing ink in liquid form. These nozzles are able to operate according to a "Drop or Dot On Demand" principle, these drops being released for example by piezoelectric effect. Other systems operate according to the "deflected jet" principle, whereby an ink jet is propelled permanently towards the substrate, and whereby electrically charged electrodes deflect this jet into a gutter at times when printing a dot is not required. The unused ink is recovered and sent back to the ink reservoir.

These components are combined in a print module which moves over the print substrate so as to cover the whole required print surface while being connected to a fixed control bay. This unit may constitute one of the stations of a machine or a line of machines for producing and customizing plastic cards or other portable objects.

On machines intended to work at high speed, for example more than 2000 cards per hour, the print module moves at a speed which is sufficiently high for the liquid ink contained in the reservoir to present significant splashing or agitation. Such agitation may give rise to a number of drawbacks: a variation in ink height and therefore in pressure and therefore in size of the ink drops deposited on the substrate, formation of bubbles in the reservoir, lack of ink coming from the outlet hose even if the reservoir is not empty, difficulty in getting a valid measurement of the ink level in the reservoir.

SUMMARY OF THE INVENTION

The objective of the present invention is to overcome one or more drawbacks of the prior art.

In this respect, the invention proposes a digital device for printing on "open" or "closed" surface substrates by demand bubble-jet comprising at least one built-in ink reservoir with a system of anti-splash partitions, at least one printhead and one buffer reservoir, the whole located in a print module which moves in relation to the substrate, characterized in that it comprises means for creating, during operation of said print module, on the one hand a vacuum in the built-in reservoir, using active regulation means for regulating this vacuum by adjustment of the ink level detected by a sensor attached to the built-in reservoir and on the other hand, the air pressure in the built-in reservoir required for printhead cleaning phases.

According to a particularity, the device is characterized in that it comprises means for pressurizing the air in the reservoir for cleaning the printhead nozzle(s).

According to a particularity, said active regulation means comprise a non-contact sensor measuring the level, without contact with the ink, through a wall of the built-in reservoir, the said sensor being connected to means for cutting off the ink flow by interrupting the supply of ink to the built-in reservoir, said means of cut-off being controlled by a circuit receiving level signals from the non-contact sensor in order to regulate the level of ink in the reservoir.

According to a particularity, said active regulation means for actively regulating the vacuum comprise a pneumatic system consisting of means for measuring the amount of vacuum and means for creating a vacuum, the pressure of which is controlled by an electronic circuit according to signals from the level sensor, ink system supply solenoid valve control signals and air system solenoid valve control signals.

According to a particularity, said means for creating a vacuum use the venturi effect.

According to a particularity, said means for creating a vacuum include a regulated vacuum pump.

According to a particularity, said print module comprises a "buffer" reservoir which can store a certain quantity of air at high or low pressure, this buffer reservoir smoothing out the pressure variations occurring in the pneumatic system.

According to a particularity, said built-in reservoir forms a storage space which contains several separators dividing this storage space into several areas covering the full height or part of the height of the reservoir, these areas having a horizontal section of the order of 1 $cm^2$, to reduce splashing of the ink.

According to a particularity, said separators comprise a number of inter-locked vertical partitions.

According to a particularity, the device is characterized in that for the nozzle cleaning phase, a flexible blade is placed in position in contact with the head equipped with the nozzles and means of movement cause the head to move in relation to the flexible blade in such a manner as to wipe the nozzle plate.

According to a particularity, the device is characterized in that a print module moves in relation to a stationary control bay and at least most of the compressed air used in the print module comes from the control bay via at least one flexible hose having sufficient length to allow movement of the print module.

According to a particularity, the device is characterized in that said wall of the ink reservoir comprises a thinner part near the sensor enabling improved operation of the ink level sensor through this thinner part, the reduction in thickness being such that the thickness of said wall at this point is less than 1 mm.

According to a particularity, at least one printhead carries a plurality of print nozzles arranged in a row inclined at an angle to a plane at right-angles to the direction of travel of this printhead in relation to the print substrate, and in that it includes means for adjusting this angle, said means of adjustment determining several preset positions enabling a change from one to another without requiring further adjustment of the angle and without altering the adjustment of these preset positions.

According to a particularity, said various preset positions correspond to angled positions making it possible with the same spacing of the print nozzles on the printhead to print according to preset resolutions by varying the spacing of the dots printed on the substrate, the spacing decreasing as the angle increases.

According to a particularity, said means of movement move at least one "cleaning" blade, which can be soaked in a solvent or rubbed on an absorbent felt before scraping the printhead, and the means of movement move at least one other "wiping" blade, scraping the outer surface of the printhead after the passage of the cleaning blade.

According to a particularity, the device is characterized in that it includes a data processing system known as a control system, receiving signals from at least one ink level sensor or pressure sensor or both, controlling the compressed air supply pressure adjustment equipment or the cut-off equipment or the distribution equipment or the non-return equipment or a combination of these components, via at least one electronic interface.

According to a particularity, the device is characterized in that the print module includes an electronic interface communicating with the control system via a series connection.

According to a particularity, the device is characterized in that it includes a drain tray, brought in front of the head to receive ink ejected from the head during purging operations.

BRIEF DESCRIPTION OF THE DRAWINGS

The invention, with its characteristics and advantages, will become clearer from reading the description given with reference to the appended drawings in which.

DETAILED DESCRIPTION OF THE PREFERRED EMBODIMENTS

Figure 1:
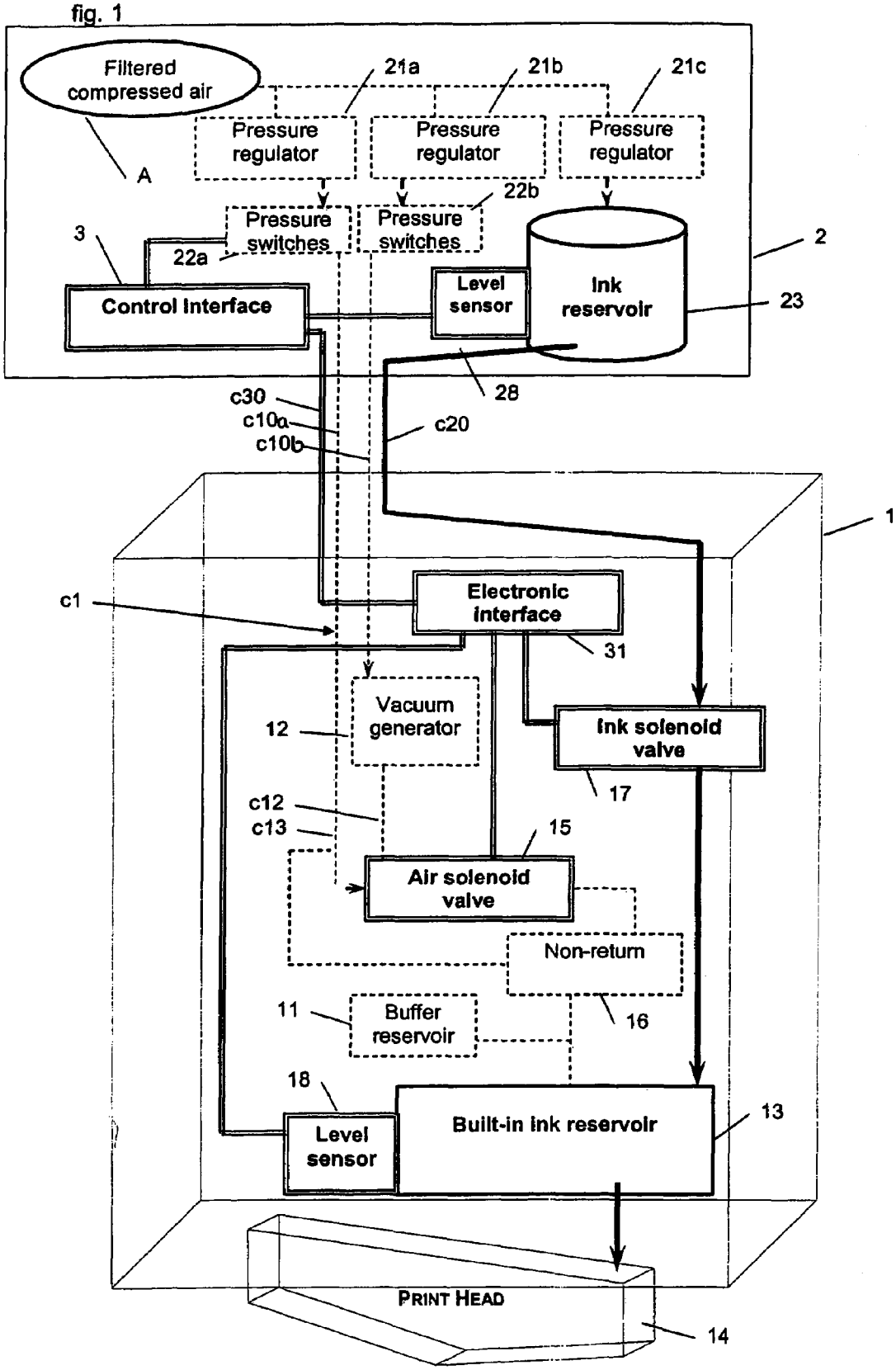
FIG. 1 shows a diagrammatic view of the device according to the invention in one embodiment.

The following description applies to a device for printing a chip card using a process operating a "drop on demand" mode, but may also apply fully or in part to a device operating in "deflected ink jet" or other operating modes, as well as to any other type of substrate, with both an "open" or "closed" surface.

In one embodiment the print device according to the invention is composed of a stationary part (2) called the control bay and a moving part (1) called the ink jet print module of the Drop On Demand type, controlled in a known way and which carries one or more printheads (14). Each printhead comprises one or more print nozzles (141) of a known type, distributed in a matrix figure able to include for example 128 or 500 nozzles over a width of a few centimeters.

In another embodiment (not shown), the print substrate moves during printing while the print module is stationary.

The unit can be incorporated into a production or customization line, and be programmed to print text or images on a substrate (5) with an "open" or "closed" surface, for example constituted by a plastic card or any other portable object, brought on a conveyor in front of the control bay (2) or under the print module (1). Each time a new substrate is in position, the print module passes one or more times according to the surface to be printed and the width of the printhead. The nozzles are controlled electronically and individually in order to spray ink drops onto the substrate, and therefore to print marks for example in the form of dots, as the module moves over the substrate or as the substrate moves under the module, and as a function of this movement.

According to the applications, it is possible to fit to the device one or more print modules able to print in juxtaposed or overlapping mode, in one or more colors.

According to the applications, it is also possible to fit to a print module one or more heads positioned relative to each other for example in order to print in juxtaposed or overlapping mode, in one or more colors.

According to the applications, it is also possible to connect each printhead to one or more built-in reservoirs, for example so as to be able to replace or clean a reservoir without stopping the printing for any length of time.

According to the applications, it is also possible to connect each reservoir to one or more printheads, for example to increase the print width that can be achieved with each color.

The present invention applies to a device including a single print module (1) that bears a single built-in ink reservoir (13) and a single printhead, but its characteristics may be applied to other combinations of these elements without departing from the spirit of the invention. In the same way the different functions of the device are described as being controlled by the same computerized control system (3) using an electronic interface (31) located in the print module (1), but may also be managed by several different systems or interfaces, or a combination of these elements, without departing from the spirit of the invention.

The printhead (14) uses print nozzles (141) spraying a drop of ink on demand via a piezoelectric actuator. In an operation of this type, the reservoir of liquid ink supplying the printhead is kept at a slightly low pressure relative to the ambient pressure, in such a way that the nozzles allow no ink to escape without an actuator command. On the other hand, to purge the nozzles before a prolonged stoppage or to unblock them in the event of a problem, the reservoir may be subjected to high pressure, for example of about 0.5 bars.

In an embodiment shown in FIG. 1, the printhead (14) is supplied with ink by a built-in reservoir (13). This built-in reservoir is supplied through a flexible hose (c20) by a main reservoir (23) pressurized by a source (A) of compressed air of a known type by means of a pressure regulator (21*c*), this same main reservoir (23) being located in the control bay (2) and fitted with a level sensor (28) connected to the control system (3) to deliver a level signal. The ink level in the built-in reservoir (13) is regulated by the control system (3), by means of the electronic interface (31), acting on cut-off means (17) including a solenoid valve closing the ink passage upstream of said built-in reservoir (13). This regulation is carried out from signals supplied by at least one non-contact capacitive effect ink level sensor (18) located on the built-in reservoir (13).

In one embodiment, a source of compressed air (A) supplies a part of the pneumatic system located in the control bay (2) through adjustment means (21*a*, 21*b*), for example pressure regulators, controlled in association with pressure measurement means (22*a*, 22*b*) by the control system (3).

These pressure measurement means (22*a*, 22*b*) may include pressure switches directly or indirectly controlling the pressure adjustment means (21*a*, 21*b*), which may be composed of pressure regulators. These pressure measurement means may also be simple pressure sensors transmitting a value to the control system (3), which controls the adjustment means (21*a*, 21*b*).

These means are controlled in order to deliver to the print module (1) a flow of compressed air at a set pressure through a first hose (c10*a*) and a second hose (c10*b*), the pressures and flows in these two hoses being able to be different.

The second hose (c10*b*) coming from the control bay (2) supplies compressed and regulated air to a venture effect vacuum generator (12) of a known type, located in the print module (1), which vacuum generator (12) imparts a slight vacuum to a part (c12) of the pneumatic system (c1) in this same print module.

The print module (1) includes distribution means (15), such as a solenoid valve, controlled by the control system (3) by means of the electronic interface (31). According to need, these distribution means bring the built-in reservoir (13) into communication with either the vacuum part (c12) of the pneumatic system, or the high pressure part (c13) located in the print module which is supplied with compressed and regulated air by the second flexible hose (c10*b*) coming from the control bay (2).

A computerized system (3) uses the signals coming from the different pressure sensors or pressure switches and controls the pressure regulators so as to maintain, outside head cleaning phases, in the built-in reservoir (13) a vacuum the value of which is calculated so as to be sufficient to retain the ink in the nozzles in normal operation without preventing its ejection by the piezoelectric actuator. In order to be free from variations in atmospheric pressure and to avoid the adjustments which might arise from them, the control system (3) may be programmed so as to maintain a vacuum in the built-in reservoir (13) such that the difference in pressure between the inside and the outside of said reservoir is stabilized at a known and independent ink level value.

Stabilizing this difference in pressure makes it possible to ensure that the size of the drops and therefore of the printed dots is regular and foreseeable, which is important in order to ensure print quality and regularity, both in time and when changing substrates, or substrate types for example between "open" and "closed".

The pneumatic system in the print module (1) includes non-return means (16), such as one or more controlled valves, or one or more clacks, or a combination of these components. These components of a known type are configured or controlled so as to seal the air inlet of the built-in ink reservoir (13) hermetically in the event of a drop in pressure due to a problem.

In one embodiment, the pneumatic system in the print module (1) includes a buffer reservoir (11) located between the distribution means (15) and the built-in reservoir (13). This reservoir may contain a certain quantity of air at high pressure or low pressure, and thus allows pressure levels in the built-in ink reservoir (13) to be regularized for example during an inflow of ink or in the event of irregularities in the supply of compressed air to the print module (1), or when there are variations in pressure caused either by the drop in the ink level through use, or by the rise in the level during re-filling.

By way of example and in one embodiment, the capacity of the buffer reservoir (11) is about 25% of the internal volume of built-in ink reservoir (13).

Figure 2:
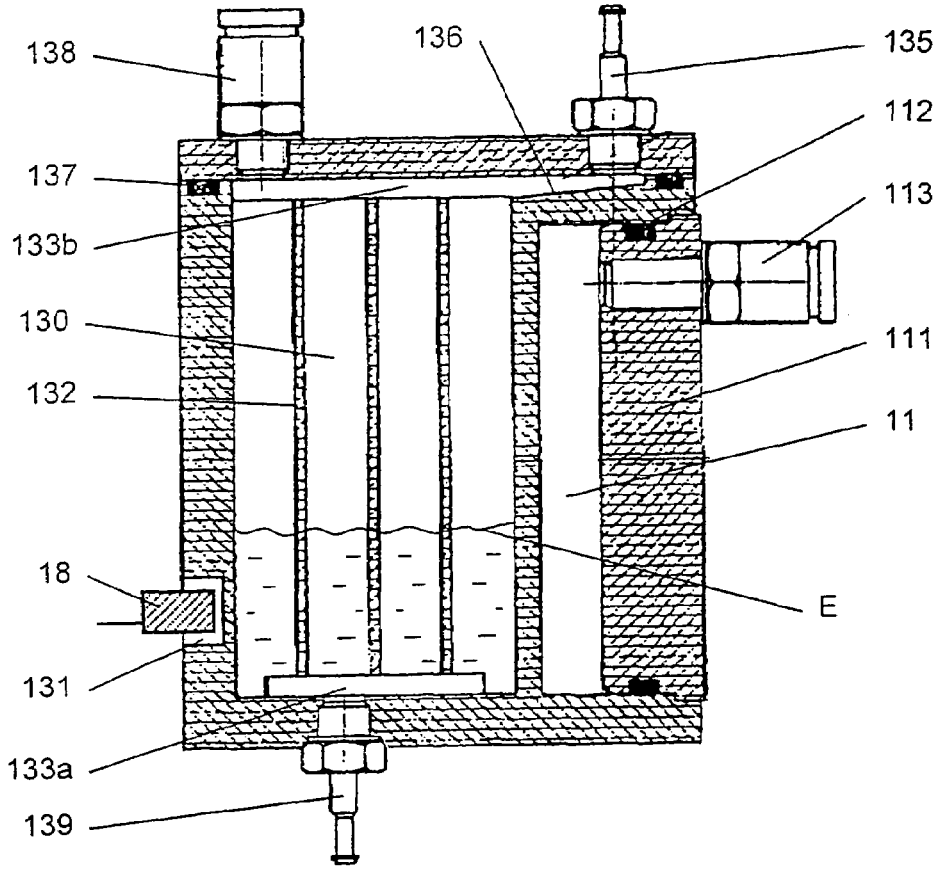
FIG. 2 shows a side view in vertical cross-section of a built-in ink reservoir of the device according to the invention in one embodiment.

In the embodiment shown in FIG. 2, a vertical wall of the built-in reservoir (13) of the print module (1) has in its lower part a thinner part (131) of an electrically non-conductive material. In this thinner part and outside the reservoir is housed a non-contact electronic sensor (18) for example with a capacitive effect of a known type, connected electronically to the control system (3) or to the electronic interface (31) or a combination of the two. By a variation in the signal representing the electrical capacity of the sensor, due to the presence or not of liquid on the other side of the wall, the control system detects the fact that ink level in the built-in reservoir (13) is below a set height corresponding to the position of this ink level sensor (18).

The thinner part (131) is such that the wall of the reservoir has a thickness of about 1 mm, for a wall of Nylon™ or Delrin™.

This ink level signal is used by the control system (3), for example so as to control the opening of the cut-off means (17) and to allow the ink to inflow into the built-in reservoir (13) coming from the main reservoir (23) as soon as the sensor detects that there is no longer sufficient ink. When the ink reaches the reservoir, the control system will be able to interrupt this inflow of ink as soon as the sensor again detects the presence of a required ink level.

The frequency of the ink supply cycles of the built-in ink reservoir (13) is reduced owing to the existence of a hysteresis loop characteristic of the level sensor (18), and the use of a time delay in taking account of sensor signals of for example 0.5 seconds, in order to avoid taking account of oscillations of level due to splashing in the reservoir.

Given its position outside the reservoir, the presence of this ink level sensor (18) causes no sealing or ink pollution problems and it is easy to clean; and since it operates without heating it causes no deterioration in the quality of the ink contained in this same reservoir, in particular when the ink used is in fact selected to be heat sensitive in respect of certain applications.

In one embodiment, the main ink reservoir (23) of the control bay (2) carries an ink level sensor (28) of the same type. This sensor (28) is connected electronically to the control system (3). By this ink level sensor (28), the control system (3) detects the fact that the ink level in the main reservoir (23) is below a pre-set height corresponding to the position of this ink level sensor (28). This signal is used by the control system (3) for example to warn a human operator of the need for an imminent re-supply of ink.

Figure 3A:
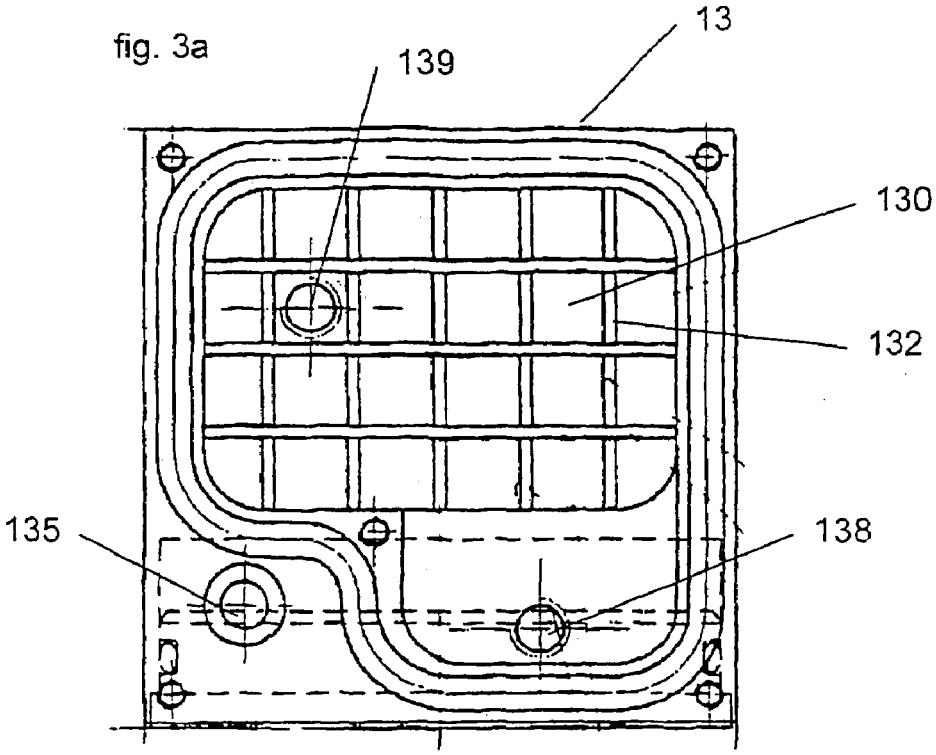
FIGS. 3*a* and 3*b* show a view from above in horizontal cross-section of a built-in ink reservoir of the device according to the invention in an embodiment comprising an anti-splash device in the form of inter-locked and honeycomb partitions respectively.

The built-in ink reservoir (13) shown in FIGS. 2 and 3*a* is in the shape of a parallelepiped receptacle the upper opening of which is closed by a lid fitted with sealing means such as a rubber seal (137).

In its lower part, the built-in ink reservoir (13) comprises an ink outflow opening (139) connected to the printhead (14) and supplying ink to the latter.

The upper lid comprises an air passage opening (138) connected to the pneumatic system in the print module (1).

This connection allows the inner space of the reservoir to be put under vacuum or under high pressure respectively according to the adjustment of the distribution means (15), in order on the one hand to compensate for ink pressure due to gravity and to retain the ink in each print nozzle (141) of the printhead (14) between two triggerings of the actuators of said print nozzles and respectively on the other hand to drain or unblock this reservoir (13) or said print nozzles (141) or the hoses connecting the reservoir (13) to the nozzles during cleaning phases.

In order to reduce ink agitation inside the built-in reservoir (13), the inner space of said reservoir is separated into several areas (130) by separators (132) constituted of interlocked vertical partitions, these partitions being for example molded with the reservoir or subsequently added to it. These partitions occupy the inner space of the reservoir over a large part of its height while leaving free a space (133*a*) located at the bottom of this same reservoir and a space (133*b*) located at the top of the reservoir. In this way, these partitions prevent or restrict all horizontal circulation within the reservoir during its movements, except in its lower part (133*a*) where the ink is able to circulate so as to distribute itself throughout the areas (130) of the inner space of this built-in reservoir (13). In the upper part of the reservoir, the free space (133*b*) above the separators (132) allows the air to circulate so as to distribute itself throughout the areas (130) of the inner space of this built-in reservoir (13).

The part of the height of the inner space of the built-in ink reservoir (13) occupied by the separators (132) may vary according to the applications. By way of example and in one embodiment, the separators (132) occupy more than 75% of this height. According to the application, the separators (132) may comprise at various points up their height transverse drilling which increases the ink circulation possibilities.

The areas (130) delimited by the separators (132) are of sufficiently small cross-section for the differences in ink height from the splashing caused by movements of the reservoir to be less than a given value, for example 10 mm. In one embodiment, the distance between the partitions constituting these separators (132) is about 6 mm.

The upper lid also comprises an ink inflow opening (135) receiving the pressurized ink from the main reservoir (23) of the control bay (2) through a flexible hose (c20) and the ink inflow cut-off means (17).

An anti-splash device of this kind makes it possible to use fast head movement (14) and therefore print speeds, without causing agitation or significant ink level variations in the reservoir, which might cause variations in static or dynamic pressure between the different nozzles (141) of the head or over time, and therefore irregular sizes for the drops and dots printed on the substrate.

In the embodiment shown in FIG. 2, the ink inflow (135) emerges above an inclined plane formed in the inner wall of the built-in ink reservoir (13). The upper surface of this inclined plane forms a debulking surface (136) onto which the ink flow will run slowly before reaching the ink storage space (E) already present in this same built-in reservoir. The shape, the inclination, or the dimensions of this debulking surface (136) may vary according to the applications, and are determined in such a way that bubbles which may be present in the ink when it flows in may disaggregate as the ink flow runs along this same debulking surface (136) or as it runs from this same surface to the reservoir storage space. In another embodiment (not shown), the ink inflow opening (135) in the built-in ink reservoir (13) may be located on a vertical wall, and the ink flow comes into contact with a debulking surface located in the same wall or opposite this ink inflow.

In another embodiment (not shown) the debulking surface (136) is formed of the peripheral surface of an approximately cylindrical wire, connecting the ink inflow (135) to an inner wall of the built-in reservoir (13) or to a separator (132). The ink flow encounters the wire when it reaches the reservoir, and runs along its surface until it meets the ink (E) already present in this same built-in reservoir.

The built-in ink reservoir (3) in FIG. 2 shows on one of its outer surfaces a channel, blocked by a lid (111) equipped with sealing means (112). The inner space of this channel is connected to the air system of the print module (1) by an air passage opening (113) and constitutes a buffer reservoir (11), which allows the pressure inside at least one part of said air system to be regularized.

Figure 3B:
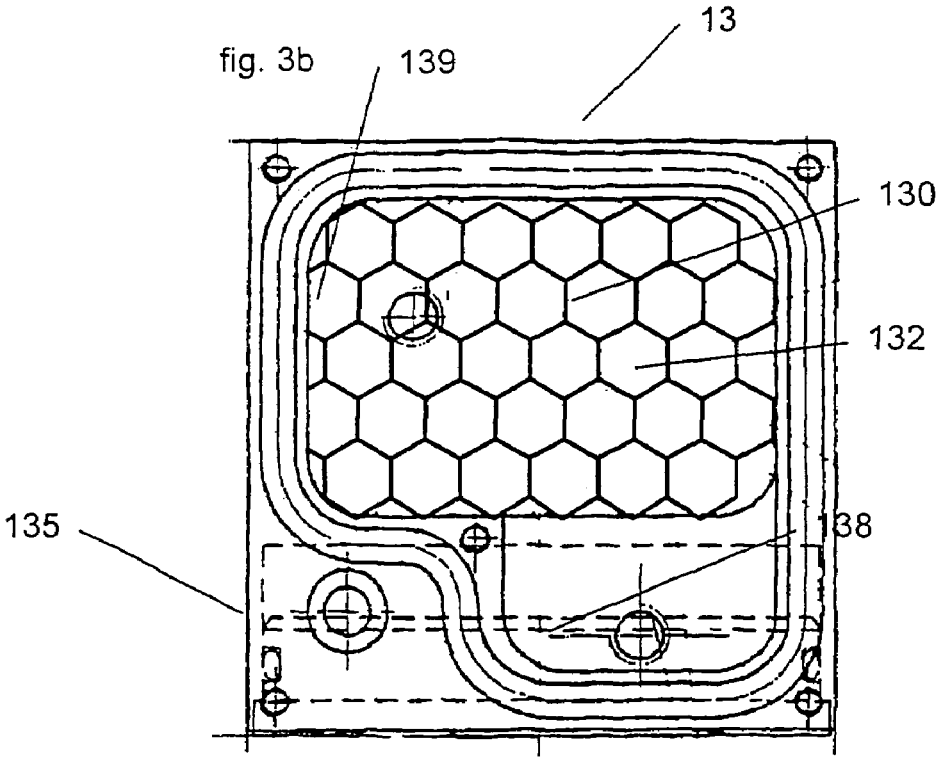

In an embodiment shown in FIG. 3*b*, the separators (132) separating the inner space of the built-in ink reservoir (13) are mainly constituted by a "honeycomb" shaped structure the conduits of which are orientated vertically and provide a free space at the bottom of the reservoir allowing a distribution of the ink between the different conduits of this structure. According to the applications, the "honeycomb" structure may comprise at various points up its height transverse drilling which increases the horizontal ink circulation possibilities.

Figure 4:
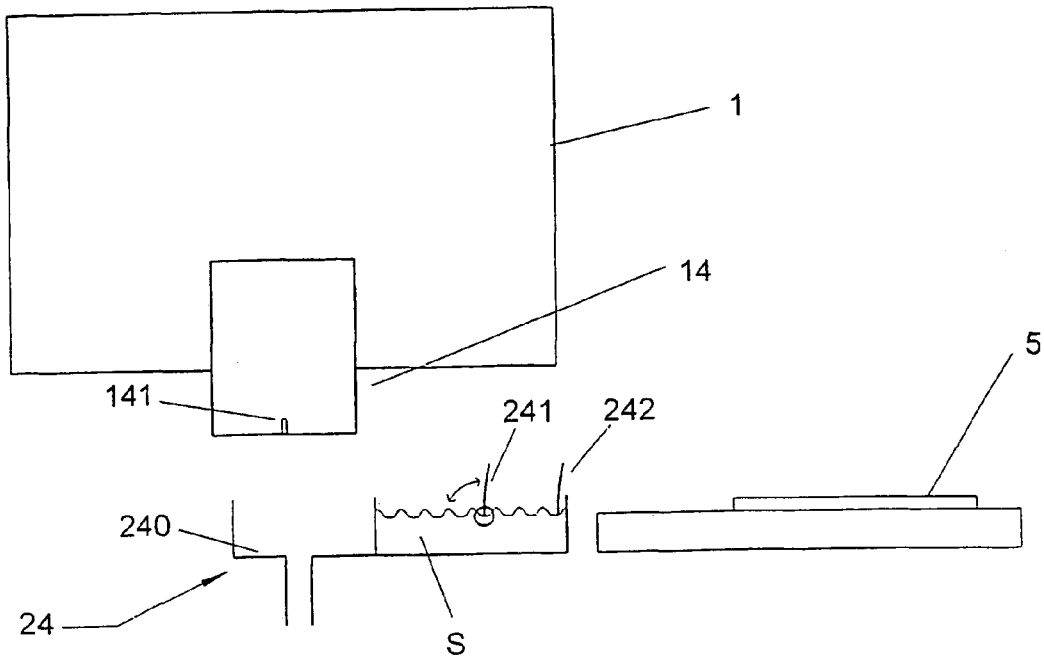
FIG. 4 shows a cross-sectional side view of a cleaning station of the device according to the invention in one embodiment.

In an embodiment shown in FIG. 4, the device according to the invention may include a cleaning station (24) to which the printhead may be brought at a command from the control system (3), either by movement of the printhead (1), or by movement of said cleaning station (24), or by a combination of the two.

The cleaning station (24) includes a drain tray (240), fitted with an outlet, receiving the ink ejected by the print nozzles (141) at a drain command, in order for example to clean or unblock said print nozzles.

The cleaning station (24) includes a tray containing a solvent (S) and is equipped with a first resilient rotary so-called cleaning blade (241). At a command from the control system (3), this cleaning blade is soaked in the solvent (S) then rotates in order to scrape the outer surface of the printhead (14), for example to unblock the print nozzles (141) after a prolonged stoppage or to clean these same nozzles after a drain operation.

The cleaning station (24) is fitted with a second resilient so-called wiping blade (242). At a command from the control system (3), this wiping blade scrapes the outer surface of the printhead (14), in order for example to wipe or dry the print nozzles (141) after a passage of the cleaning blade (241). This device also removes any vestiges of dirt which might be left from the previous scraping.

In one embodiment the cleaning station (24) is fitted with elevation means (not shown), for example in the form of a rack and pinion mechanism, bringing this same cleaning station to the level of the line of movement of the print substrates, and allowing a cleaning of the printhead (14) without disassembly of the latter.

Figure 5:
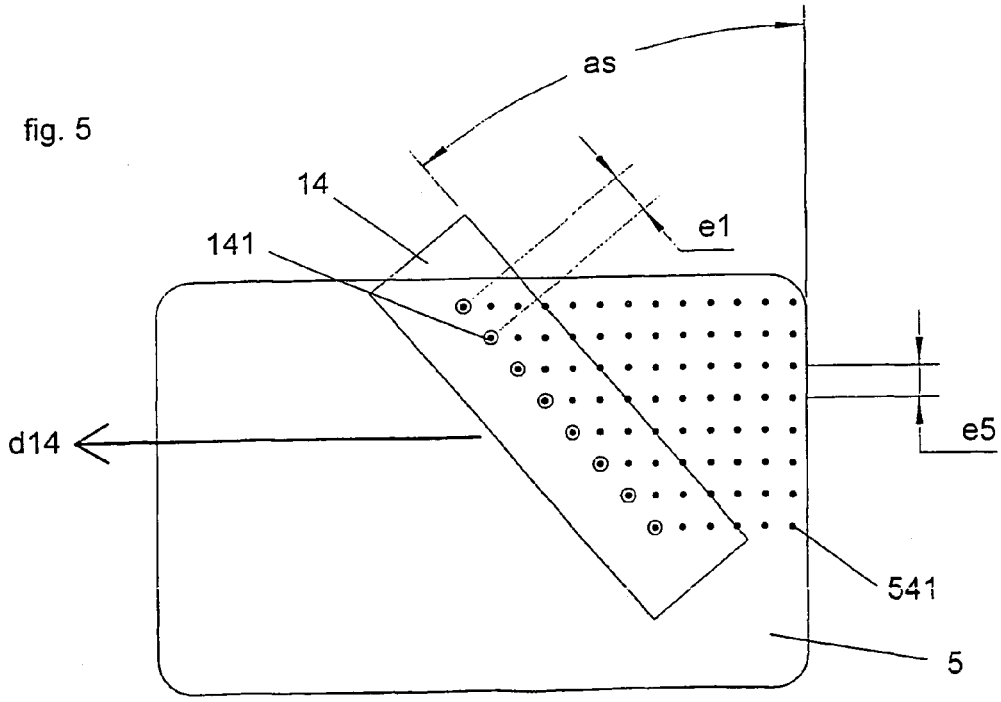
FIG. 5 shows a view from above of the print nozzle positions in relation to the print substrate during a passage of a printhead in respect of a device according to the invention in one embodiment.
Figure 6:
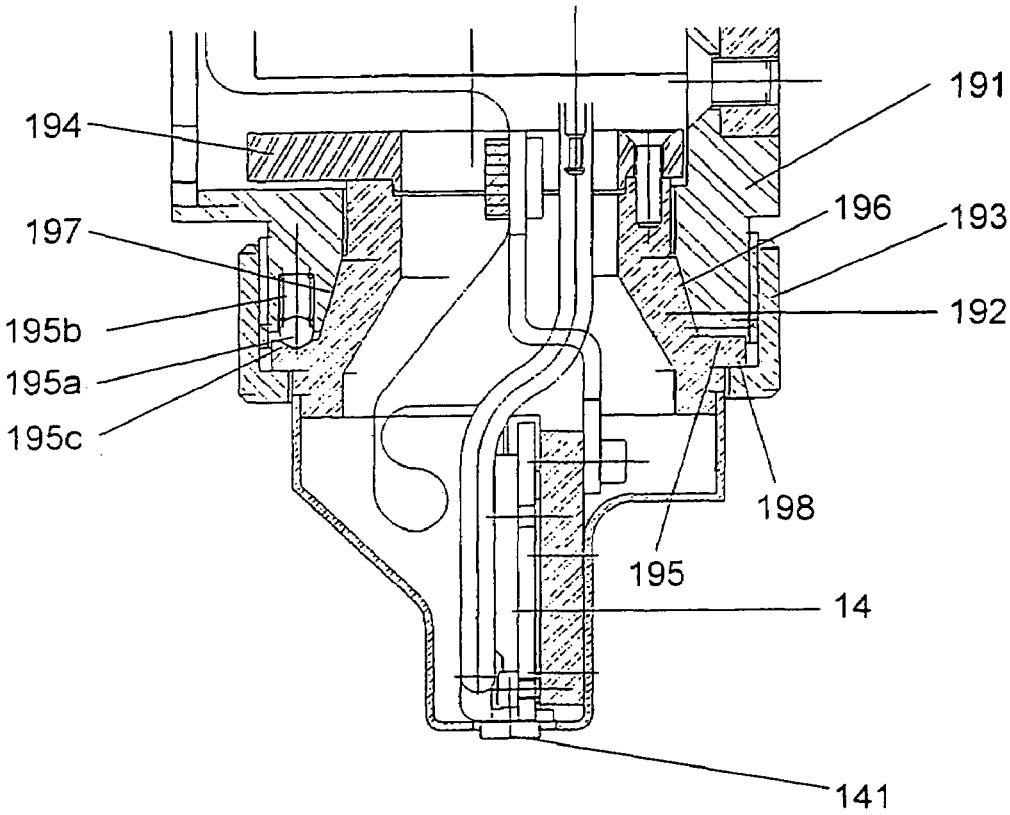
FIGS. 6 and 7 show respectively a partial view in side cross-section and in underneath cross-section of the print module part bearing the printhead.
Figure 7:
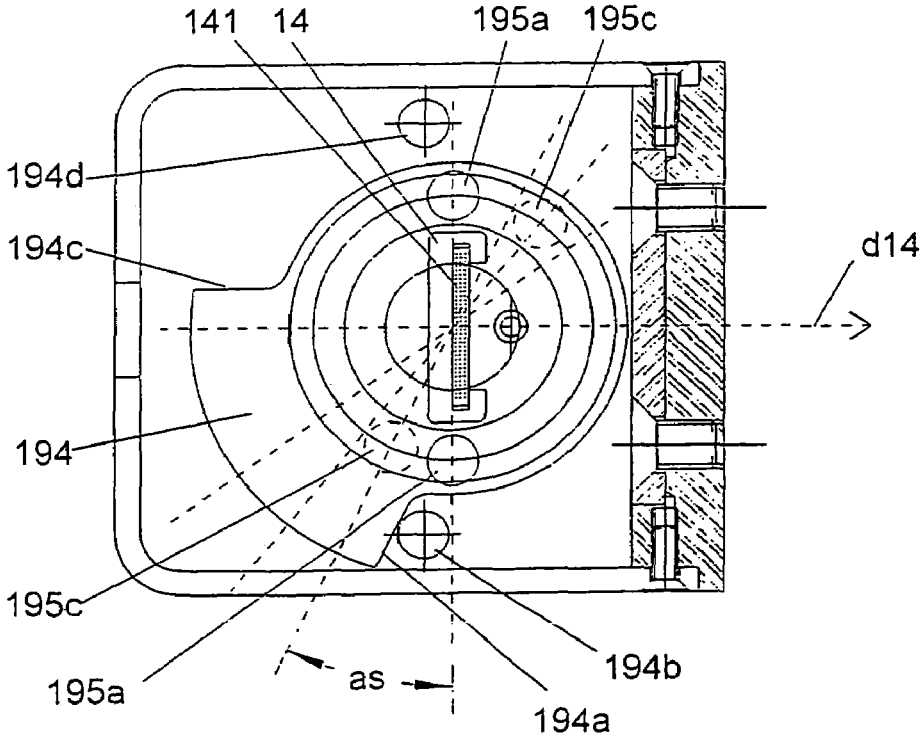

In the embodiment shown in FIGS. 5, 6, and 7, the device according to the invention includes a printhead (14) the print nozzles (141) of which are arranged in one or more rows parallel to each other, and the nozzles of a same row have between them a pre-set spacing (e1) according to their alignment in the row.

In order to be able to modify the print resolution, the printhead (14) is integral with a moving part (192) rotating relative to a stationary part (191) integral with the print module (1), this rotation occurring around an axis of inclination (d19) perpendicular to the plane of the print substrate (5).

The printhead (14) may then be positioned in such a way that the rows of print nozzles (141) form a pre-set angle (as) called a "slantage" angle with a plane perpendicular to the direction (d14) of relative movement of this printhead (141) over the substrate (5) during a print phase. In this way, the dots (541) printed on the print substrate (5) have between them a clearance (e5) smaller than the spacing (e1) existing between the print nozzles (141). Such an arrangement thus makes it possible to increase the print resolution achievable with a given printhead, in other words the number of dots printed over a given length or surface.

The moving part (192) of the head has a convex surface (196) of conical shape engaging with a complementary concave surface (197) carried by the stationary part (191) in order to guide this same moving part (192) in rotation along the axis of inclination (d19). The moving part (192) also has a part forming a shoulder (198), directed towards the print substrate (5). On this shoulder is supported an inner shoulder of a bush (193) surrounding the mobile part (192). Rotating this bush (193) then locks the moving part (192) by tightening its conical surface (196) against the conical surface (197) of the stationary part (191) owing to a thread carried by this same bush (193) and engaging with a thread carried by this same stationary part (191).

In order to be able to be adjusted easily according to one or more pre-set angled positions, the moving part (192) comprises a cam (194) having one or more sides (194*a*, 194*c*), with radial surfaces, which engage with one or more stop components (194*b*, 194*d*) integral with the stationary part (191) in order to form one or more stops. Depending on the relative position of the sides (194*a*, 194*c*) and stop components (194*b*, 194*d*), one or more pre-set angled positions are selectable in this way, simply by loosening the bush (193) before swiveling the moving part (192) as far as one of the stops then re-tightening the bush.

In another embodiment, the moving part (192) has an annular surface (195) with the approximate shape of a disk portion perpendicular to the axis of inclination (d19) and having on its surface facing towards the stationary part (191) one or more depressions (195*c*). On this annular surface (195) a ball (195*a*) maintained in a blind indent integral with the stationary part (191) is pressed by the action of a spring (195*b*) compressed into this same indent. When the moving part (192) is rotated relative to the stationary part (191), a ball (195*a*) opposite a depression (195*c*) centers itself in it under the action on the spring (195*b*) and thus determines a precise angled position. The presence of one or more balls and one or more depressions thus makes it possible to define a pre-set number of pre-set angled positions of the moving part (192) relative to the stationary part (191).

Such a device thus makes it possible to vary rapidly the angle of the printhead (14), without the necessity for further adjustment during these modifications, and thus to adapt print resolution to current production needs in a flexible, fast and accurate way, particularly when the change of substrate, for example between "open" and "closed", requires a change of resolution in order to preserve the best possible print quality while avoiding some of the problems due to coalescence or to the size of the drops before drying.

The device according to the invention is controlled by a control system (3) comprising a computer, for example of the compatible personal computer type. This system receives signals from the ink level sensors (18, 28) or pressure sensors (22*a*, 22*b*) or both of these, and controls the means (21*a*, 21*b*, 21*c*) for adjusting the compressed air supply pressure or the cut-off means (17) or the distribution means (15) or the non-return means (16) or a combination of these components, by means of at least one electronic interface. In one embodiment, all the functions and signals of the printed module (1) are managed by one electronic interface (31) of a known type, this electronic interface communicating with the control system (3) by a series connection (c30) operating for example according to the Universal Serial Bus computing standard. Using such a connection then enables easy replacement of the control system (3) or the print module (1), for example for reasons of maintenance, system updating, or for replacing one print module by another comprising different settings or having different performance.

It must be obvious for those skilled in the art that the present invention allows embodiments in a number of other specific forms without departing from the field of application of the invention as claimed. Consequently, the present embodiments must be considered as examples, but may be modified in the field defined by the scope of the attached claims, and the invention must not be restricted to the details given above.

What is claimed is:

1. Digital device for printing on "open" or "closed" surface substrates by demand bubble-jet comprising a main reservoir and a print module which moves in relation to the substrate, said print module containing at least one built-in ink reservoir with a system of anti-splash partitions, at least one printhead and one buffer reservoir, characterized in that it comprises:

an ink level sensor attached to said main reservoir for detecting the ink level in said main reservoir;

an ink inflow at the top of said built-in ink reservoir for receiving pressurized ink from the main reservoir;

means for creating, during operation of said print module, on the one hand, a vacuum in the built-in ink reservoir, and, on the other hand, an air pressure in the built-in ink reservoir for printhead cleaning phases;

a sensor attached to said built-in ink reservoir for detecting the ink level in said built-in ink reservoir; and active regulation means using said sensor for regulating said vacuum by adjustment of the built-in ink reservoir ink level and controlling flow of ink coming through said ink inflow into the built-in ink reservoir.

2. Device of claim 1, wherein said printhead includes nozzles and further comprising a means for pressurizing the air in the reservoir for cleaning the printhead nozzle(s).

3. Device of claim 2, characterized in that for the nozzle cleaning, a flexible blade is placed in position in contact with the printhead equipped with the nozzles and means of movement cause the printhead to move in relation to the flexible blade in such a manner as to wipe the nozzle.

4. Device of claim 3, characterized in that said means of movement move at least one cleaning blade, adapted to be soaked in a solvent or rubbed on an absorbent felt before scraping the printhead, and the means of movement moves at least one other wiping blade, scraping an outer surface of the printhead after passage of the cleaning blade.

5. Device of claim 3, characterized in that it includes a drain tray, positioned in front of the head to receive ink ejected from the head during purging operations.

6. Device of claim 1, characterized in that said regulation means comprises a non-contact sensor for measuring the ink level, without contact with the ink, through a wall of the built-in ink reservoir, the non-contact sensor being connected to means for cutting off the ink flow by interrupting the supply of ink to the built-in ink reservoir, said means for cutting off the ink being controlled by a circuit receiving level signals from the non-contact sensor in order to regulate the level of ink in the reservoir.

7. Device of claim 6, characterized in that said wall of the built-in ink reservoir has a portion with a reduction in thickness forming a thinner part near the sensor so as to enable improved operation of the ink level sensor through said thinner part, the reduction in thickness being such that the thickness of said wall at this point is less than 1 mm.

8. Device of claim 1, characterized in that said active regulation means for actively regulating the vacuum comprises a pneumatic system consisting of a means for measuring the amount of vacuum and a means for creating a vacuum, and an electronic circuit for controlling pressure according to ink system supply solenoid valve control signals, air system solenoid valve control signals and signals from the level sensor.

9. Device of claim 8, characterized in that said print module comprises a buffer reservoir for storing a certain quantity of air at high or low pressure, said buffer reservoir smoothing out pressure variations occurring in the pneumatic system.

10. Device of claim 1, characterized in that said means for creating a vacuum use a venturi effect.

11. Device of claim 1, characterized in that said means for creating a vacuum include a regulated vacuum pump.

12. Device of claim 1, characterized in that said built-in ink reservoir comprises a storage space containing several separators dividing said storage space into several areas covering at least a part of the height of the reservoir, said areas having a horizontal section of the order of 1 $cm^2$, to reduce splashing of the ink.

13. Device of claim 12, characterized in that said separators comprise a number of inter-locked vertical partitions.

14. Device of claim 1, characterized in that a print module moves in relation to a stationary control bay and most of the air pressure used in the print module comes from the control bay via at least one flexible hose having sufficient length to allow movement of the print module.

15. Device of claim 1, characterized in that at least one printhead carries a number of print nozzles arranged in preset positions in a row inclined at an angle to a plane at right-angles to the direction of travel of said printhead in relation to the substrate, and further including means for adjusting said angle, said means for adjustment determining several preset positions enabling a change from one to another without requiring further adjustment of the angle and without altering the adjustment of said preset positions.

16. Device of claim 15, characterized in that said various preset positions correspond to angled positions making it possible with same spacing of the print nozzles on the printhead to print according to preset resolutions by varying spacing of the dots printed on the substrate, the spacing of the dots decreasing as the angle increases.

17. Device of claim 1, characterized in that it includes a data processing control system receiving signals from at least one ink level sensor or pressure sensor or both, and controlling one or more components including a compressed air supply pressure adjustment component or an ink cut-off component or an air distribution component or an air non-return component or a combination of said components, via at least one electronic interface.

18. Device of claim 17, characterized in that said print module includes an electronic interface communicating with the control system via a series connection.

* * * * *